8/14/79 XR 4,164,477 A

United States Patent [19]

Whitley

[11] 4,164,477

[45] Aug. 14, 1979

[54] FUNGICIDAL DETERGENT COMPOSITION

[75] Inventor: Elmer E. Whitley, Harlingen, Tex.

[73] Assignee: Chem-X3, Inc., Harlingen, Tex.

[21] Appl. No.: 947,537

[22] Filed: Oct. 2, 1978

[51] Int. Cl.[2] ..... C11D 3/065; C11D 7/56

[52] U.S. Cl. ..... 252/99; 134/3; 134/42; 252/102; 252/103; 252/106; 252/527; 252/529; 252/539

[58] Field of Search ..... 134/2, 3, 42; 252/99, 252/103, 106, DIG. 3, DIG. 14, 356, 102, 527, 529, 539; 424/78, 145; 528/301

[56] References Cited

U.S. PATENT DOCUMENTS

| | | | |
|---|---|---|---|
| 1,967,220 | 7/1934 | Barrett et al. | 134/17 |
| 2,023,388 | 12/1935 | Harris | 252/1 |
| 3,079,213 | 2/1963 | Mendelson et al. | 8/115.5 |
| 3,509,254 | 4/1970 | Krofinger et al. | 424/76 |
| 3,992,146 | 11/1976 | Fazzalari | 21/58 |
| 4,028,261 | 6/1977 | Peterson et al. | 252/89 R |
| 4,097,395 | 6/1978 | Posey et al. | 252/106 |

FOREIGN PATENT DOCUMENTS

| | | | |
|---|---|---|---|
| 282098 | 11/1966 | Australia | 424/145 |
| 494639 | 10/1938 | United Kingdom | 252/356 |

OTHER PUBLICATIONS

McCutcheon's, "Detergents and Emulfiers," 1967 Annual.

*Primary Examiner*—Willis, Jr. P. E.
*Attorney, Agent, or Firm*—Neal J. Mosely

[57] ABSTRACT

A fungicidal detergent concentrate contains a water soluble organic carboxylic acid, a zinc salt, e.g. zinc sulfate, a modified phthalic glycerol alkyd resin wetting agent-dispersant and conventional cleaning additives that function as degreasants, penetrants, surfactants, and the like. Optionally, the composition may contain a bleach, e.g. calcium hypochlorite or sodium hypochlorite or hydrogen peroxide. A method is also provided for removing mold and mildew from surfaces which comprises the steps mixing the concentrate with water and bleach and using the diluted mixture to clean the mold and mildew from the surface.

6 Claims, No Drawings

FUNGICIDAL DETERGENT COMPOSITION

BACKGROUND OF THE INVENTION

1. Field of the Invention

The present invention relates to detergent compositions of cleaning surfaces and destroying and preventing the regrowth of mold and mildew.

In many areas of the world, the unwanted growth of mold and mildew is an annoying problem. The rapid growth of mold and mildew on surfaces, such as house walls, bathroom walls, and the like, is particularly troublesome in hot, humid climates.

Prior to the prevent invention, once mold and mildew appeared on a surface it was not only very difficult to remove but its regrowth was almost certain.

A costly problem occurs when mold and mildew is present on a surface that needs to be painted. In order to paint or repaint properly a surface that has become infested with mold or mildew, it is necessary to remove the mold and mildew completely. Prior to the present invention, the most widely used method for removing mold and mildew was to scrub vigorously the infected area until the mold and mildew was removed. Indeed, it is believed that prior to the present invention, no product was available that would instantly kill or remove mold and mildew without vigorous scrubbing.

2. Brief Description of the Prior Art

Halvorson et al. U.S. Pat. No. 2,138,805 discloses the incorporation of germicides in detergent compositions.

Werntz U.S. Pat. No. 2,473,460 discloses detergent compositions containing bleaching agents.

Fazzalari U.S. Pat. No. 3,992,146 discloses the use of copper sulfate as a bilcidal agent.

Shibe et al. U.S. Pat. No. 3,272,751 discloses cleaning compositions containing certain zinc halide complexes.

Chemical Abstracts 46, 6786 discloses fungicidal properties of acetic acid.

Chemical Abstracts 57, 12950 discloses the use of hydrogen peroxide or sodium hypochlorite or calcium hypochlorite for sterilizing seeds.

None of this prior art discloses detergent compositions containing fungicides which are retained on the surface cleaned to remove and inhibit regrowth of mold and mildew.

SUMMARY OF THE INVENTION

In this invention, a concentrate is provided which, when admixed with an oxidizing agent and used to clean an infested surface removes and inhibits regrowth of mold and mildew. The concentrate includes an organic acid, such as acetic acid or the like, a water soluble zinc salt, such as zinc sulfate, a modification phthalic glycerol alkyd resin wetting agent-dispersant, and conventional cleaning additives that function as degreasants, penetrants, surfactants, and the like. Optionally, the composition may contain a bleach, e.g. calcium hypochlorite or sodium hypochlorite or hydrogen peroxide.

Accordingly, it is one object of the present invention to provide a novel detergent composition for removing mold and mildew from a surface and inhibiting regrowth thereon.

Another object of the invention is provide a novel method for removing mold and mildew from an infested surface and inhibiting regrowth thereon.

Other objects of this invention will be apparent from time to time throughout the specification and claims as hereinafter related.

DESCRIPTION OF THE PREFERRED EMBODIMENTS

The fungicidal or mold and mildew inhibiting detergent composition of the present invention is a mixture containing an organic acid, a zinc salt, such as zinc sulfate, a polymeric wetting agent-disperant, and various detergents and surfactants.

The concentrate is prepared by adding a quantity of water to a mixing vessel and thereafter adding a water soluble organic acid to the water in the vessel. The water and organic acid are the mixed to provide a homogenous solution.

In a separate vessel, or mixing zone, a cleaning solution is prepared. The cleaning solution contains ingredients which function as degreasants, penetrants, surfactants and wetting agents which will be described more fully hereinafter. These agents are dissolved in water to form a solution. The cleaning solution is then added to and mixed with the solution of organic acid in the mixing vessel. An alkali or alkaline earth metal tripolyphosphate may be included as the degreasant in the cleaning solution or may be added to the mixing vessel after the cleaning solution is added. A water solution of a fungicide is then added to the mixing vessel. All of the constituents in the mixing vessel are then mixed to yield a homogenous concentrate.

Prior art cleaning compositions, which contain various additives, are disclosed in U.S. Pat. Nos. 2,138,805; 2,473,460; 2,645,615 and 3,282,852.

In accordance with the present invention, the preferred organic acid for incorporation into the mold and mildew remover concentrate is acetic acid, and preferably, naturally occurring acetic acid such as vinegar. Other water soluble lower aliphatic carboxylic acids which may be used in the concentrate are formic, propionic, n-butanoic, n-pentanoic, trimethylacetic, n-hexanoic, lactic, methoxyacetic, cyanoacetic, chloroacetic, citric, partaric, etc.

A typical degreasant which is used in the cleaning solution is sodium metasilicate. The penetrants are materials which penetrate oily, dirty surfaces such as alkanolamide detergents and the tetrasodium salt of ethyldiaminetetraacetic acid (EDTA). The surfactants which are used in the cleaning solution are preferably of the nonionic detergent or fatty alcohol type, although cationic and anionic detergents and sodium soaps of fatty acids may be used with lesser efficiency. An alkali metal or alkaline earth metal tripolyphosphate may serve as the degreasant in the cleaning solution or may be included as an additional ingredient in the concentrate to function as a degreasant and a water softener.

The fungicides used in the concentrate are water soluble zinc salts, e.g. zinc sulfate, zinc acetate, zinc bromide, zinc chloride, zinc iodide, zinc nitrate, zinc bromate, and zinc chlorate. Zinc sulfate is preferred.

The wetting agent used is a polymeric wetting agent-dispersant which disperses the ingredients and wets the surface being treated but when dry resists rewetting and removal of the fungicidal ingredient. A preferred wetting agent is a commercially available modified phthalic glycerol alkyd resin, TRITON B-1956 (identified by the manufacturer as a nonionic surfactant manufactured by reaction of polyglycerol with phthalic anhydride).

The ingredients of the mold and mildew remover concentrate may be present in the range in set forth in Table 1 below.

TABLE 1

| Ingredient | Range in % by Weight |
|---|---|
| Water | 97.75–82.40 |
| Organic Acid | 2.0–10.0 |
| Degreasant | 0–2.0 |
| Penetrant | 0–0.8 |
| Surfactant | 0.1–1.0 |
| Wetting Agent | 0.05–1.0 |
| Tripolyphosphate | 0–0.8 |
| Fungicide | 0.2–2.0 |

The combination of cleaning ingredients in the mold and mildew remover concentrate is essential in order to kill mold and mildew and prevent regrowth. This is particularly true since most surfaces to be treated have an accumulation of dirt and grease in addition to a growth of mold and mildew thereon. It should be apparent that the function of the cleaning solution is to cut through the dirt and grease and allow the fungicidal ingredients to kill the mold and mildew. In this regard, a preferred composition for the mold and mildew remover concentrate is shown in Table 2 below.

TABLE 2

| Ingredient | Percentage by Weight |
|---|---|
| Water | 93.6 |
| Organic Acid (Acetic Acid) | 3.56 |
| Degreasant (Sodium Metasilicate) | 0.76 |
| Penetrants (EDTA and Ethanolamide | 0.57 |
| Surfactants (Nonionic) | 0.38 |
| Wetting Agent (TRITON B-1956) | 0.19 |
| Sodiumtriphosphate | 0.38 |
| Zinc Sulfate | 1.00 |

The procedure for preparing the mold and mildew concentrate of the present invention is further illustrated by the following examples:

EXAMPLE 1

Twenty gallons of water is added to a barrel having a 55-gallon capacity. Twenty-four gallons of vinegar is then added to the barrel. The vinegar has an acetic acid content of 10% by weight. The ingredients are mixed thoroughly to yield a homogenous acid solution.

To prepare the cleaning solution, into a separate mixing vessel having at least a 2-gallon capacity, the following ingredients are admixed: Sodium metasilicate, tetrasodium salt of ethyldiaminetetraacetic acid (EDTA), an alkanolamide detergent, a linear alkoxypolyoxy alkyene ethanol surfactant and water.

The following ingredients are added to the separate mixing vessel in an amount ot yield a cleaning solution having the composition in percent by weight as set forth in Table 3 below:

TABLE 3

| Ingredient | Percentage by Weight |
|---|---|
| Sodium Metasilicate | 20 |
| Tetrasodium EDTA | 10 |
| Modified Phthalic Glycerol Alkyd Resin-Wetting Agent | 5 |
| Alkanolamide Detergent | 5 |
| Linear Alkoxypolyoxyl alkyene ethanol | 10 |
| Water | 50 |

The tetrasodium salt of ethylaminediaminetetraacetic acid (EDTA) used in Example 1 was obtained from the Dow Chemical Co., Midland, Michigan, under the trademark Versene Powder. The alkanolamide detergent was obtained from the Stepan Chemical Co., under their designation Ninol 1285. The Ninol 1285 detergent is an alkanolamide (a C1-C3 alkanolamide of a fatty acid) with excellent degreasing properties. The linear alkoxypolyoxy alkyene ethanol used is a product manufactured by the Stepan Chemical Company under the designation of Stepan EA-10. This Stepan EA-10 surfactant is a high foaming biodegradable nonionic surfactant.

The foregoing ingredients are diluted and mixed with water to yeild 2 gallons of cleaning solution containing about 50% water by weight. Two gallons of the cleaning solution is then added to the solution of acetic acid in the mixing vessel. Thereafter, 2 gallons of sodiumtripolyphosphate in water is added to the mixing vessel. The amount of sodiumtripolyphosphate in the solution to yield a detergent concentrate containing 0.38% wt. sodiumtripolyphosphate as set forth in Table 2 above. In another mixing zone, 5 pounds zinc sulfate (tetrahydrate) is dissolved in 5-gallons of hot (180° F.) water and then added to the mixing vessel.

The ingredients in the mixing vessel are then mixed to yield a homogenous solution. The chemical analysis of the resulting concentrate made by the foregoing procedure is set forth in Table 4 below:

TABLE 4

| Function | Ingredient | Percentage by Wt. |
|---|---|---|
| Organic Acid | Acetic Acid | 3.56 |
| Degreasant | Sodiummetasilicate | 0.76 |
| Penetrant | Tetrasodium (EDTA) | 0.38 |
| Wetting Agent | TRITON B-1956 | 0.19 |
| Surfactant | Stepan EA-10 | 0.38 |
| Penetrant | NINOL 1285 | 0.19 |
| Fungicide | Zinc Sulfate | 1.00 |
| Water Softener | Sodiumtripolyphosphate | 0.38 |
| Diluent | Water | 93.16 |

As shown in Example 1, the concentrate of the present invention includes a cleaning solution. In other embodiments of the invention, the cleaning solution may include, in addition to the other constituents, a higher alkyl aryl sulfonate detergent, a multi-branched higher alkyl polyoxyethylene ethanol and an alkanolamine detergent.

A cleaning solution of superior properties can be formulated which includes about 10–40% wt. of a mixture of a water soluble higher alkyl mononuclear aryl sulfonate salt having about 8–15 carbon atoms in the alkyl group and a multi-branched alkyl polyoxyethylene ethanol surfactant having about 8–18 carbon atoms in said alkyl group and an average of about 5–30 ethyleneoxide groups, the ratio of said sulfonate to polyethoxamer being from about 10:1 to about 1:4 by weight with at least about 3% of each material present in the composition. About 5–20% wt. of a water soluble alkanolamine or alkanolamide having 2–3 carbons in the alkanol group should also be present in the cleaning solution. This solution may be mixed with the wetting agent and fungicide salt, as described above, and may be diluted by admixture with the dilute aqueous solution of acetic acid.

EXAMPLE 2

In an alternant embodiment of the invention, a concentrate otherwise similar to the embodiment of Example 1 contains a cleaning solution which includes an alkaline metal higher alkyl benzene sulfonate, multi-branched tridecyl polyoxyethylene ethanol and triethanolamine.

With regard to the higher alkyl mononuclear aryl sulfonate detergent, it is preferred to use the higher alkyl benzene sulfonates, however, other similar detergents having a mononuclear aryl group derived from toluene or xylene may be also used. The aryl nuculeus has at least one alkyl substituent having an average number of about 8-15 carbons and preferably about 12-15 carbons. The alkyl group may be branched and is usually derived from polymers of lower mono-olefins. A commercial tridecyl benzene contains a mixture of propylene polymers averaging about 13 carbons. The alkyl group may be straight chain such as n-decyl, dodecyl and tridecyl.

The higher alkyl aryl sulfonate detergent material is employment preferably in the form of its alkali metal salt, particularly the sodium salt. Other water soluble salts may be used such as the potassium salt and ammonium salt.

The alky polyethoxamer is prepared usually by the reaction of the higher aliphatic alcohols having 8-18 carbons with a predetermined proportion, within the range of 5 to 30 moles, of ethyleneoxide in order to obtain a product having the desired physical properties and performance characteristics. Satisfactory results are obtained with polyethoxamers (preferably 10-20 moles of ethyleneoxide) of multi-branched higher alcohols (preferably containing 11-15 carbons) such as produced by the Oxo process, well known in the art. This process involves the reaction of a multi-branched olefin of 7-17 carbons (e.g. tri-, tetra-, pentapropylene and di-isobutalene) with carbon monoxide and hydrogen to form the corresponding aldehyde, followed by reduction to the corresponding primary alcohol. Similar alcohols may be obtained by other processes however. The polyethoxomer of tridecyl alcohol (corresponding to alcohol produced from tetrapropylene and/or triisobutylene by the Oxo process) is particularly satisfactory. The optimum proportion of condensed ethyleneoxide varies with the type of alcohol so as to produce a suitable water soluble derivative having the desired solubilizing detergent and foaming effects. As indicated, the preferred of ethyleneoxide to alcohol corresponds to the reaction product of an average of 10-20 moles ethyleneoxide with tridecyl alcohol.

The alkanolamines and alkanolamides have one or more hydroxy alkyl groups of 2-3 carbons, such as mono-, di- or triethanolamine isopropanol amine or the like. Good results are obtained when triethanolamine is employed which in commercial form may contain small amounts of mono- and diethanolamine. The alkanolamine or alkanolamide used is considered to be essentially in free form so as to be available for its necessary contribution. Where alkyolamine detergent salts are employed, an excess of alkanolamine should be used of the pH adjusted with caustic soda or the like so as to release or otherwise render effective the alkanolamine in the composition. In general, the pH of the final cleaning solution is at least about 9, usually in the range of about 9.5-12, and preferably from 10-11.5.

The desirable qualities of the cleaning solution are a result of the mutual effects or interaction of the ingredients in proper proportions in the combination. The alkyl benzene sulfonate detergent, the polyethoxyamer, and the alkanolamine or alkanolamide detergent contribute to the desired properties of the system. As indicated, the total amount of sulfonate detergent and polyethoxamer is within the range of 10-40%, preferably 20-30% of the liquid. The ratio of sulfonate to polyethoxyamer is selected from a range of about 10:1 to 1:4, preferably 5:1 to 1:1 with at least 3% of each in the liquid. The alkanolamine or alkanolamide is about 5-20%, preferably 7-12% of the composition. In general, the combination of the sulfonate detergent and polyethyoxyamer yields improved detergency as compared to similar products having only one of these materials in the same total concentration.

The cleaning solution is prepared in any suitable manner by admixture at room temperature or reasonably elevated temperatures depending upon the specific ingredients used. A preferred method utilizes room temperature for admixing the main ingredients to a homogenous solution. This procedure involves preparing an aqueous slurry of the alkyl benzene sulfonate essentially from inorganic salts. A suitable base is an aqueous slurry of 56% solids having sodiumalkyl benzene sulfonate in at least 95% by weight of solids. It is convenient to addition of water at this stage to thin the mixture to facilitate mixing. The liquid triethanolamine or the like and the polyethoxyamer are added in any desired order with stirring. Any additional agents are added in powdered or solution form as desired from moderate heating, if necessary, to facilitate formation of a homogenous solution or dispersion.

The cleaning solution prepared, as described above, is admixed with the zinc sulfate fungicide and the TRITON B-1956 wetting agent-dispersant and then diluted with the aqueous solution of acetic acid to produce a fungicidal detergent concentrate, as described in Example 1.

EXAMPLE 3

This example is further illustrative of the cleaning solutions of the present invention. In this example, as set forth below in Table 5 illustrates a further composition of the cleaning solution.

TABLE 5

| Ingredients | Percentage by Weight |
|---|---|
| Sodium dodecyl sulfonate | 18 |
| Tridecylpolyeoxyethylene ethanol | 8 |
| Triethanolamine | 10 |
| TRITON B-1956 wetting agent | 5 |
| Water and other constituents | Balance |

In the formulation set forth above, the dodecyl benzene sulfonate is derived from a propylene tetramer. It is listed in the table on an active ingredient basis is substantially free of inorganic salts. The tridecyl alcohol is produced by the Oxo process, as previously described, and condensed with an average of about 15 moles ethyleneoxide. A solution of zinc sulfate in water is mixed into this composition as in Example 1.

The final formulation is a homogenous, pourable heavy duty liquid at room temperature with superior properties. This solution is mixed with the dilute solution of acetic acid, as in Example 1, to yield the desired cleaning concentrate.

EXAMPLE 4

The formulation of Example 3 is repeated except that the following approximate proportions are used for the ingredients specified below:

TABLE 6

| Ingredients | Percentage by Weight |
|---|---|
| Sodium tridecyl sulfonate | 5 |
| Tridecyl polyethoxyamer (15 moles ethylene oxide) | 15 |
| Triethanolamine | 10 |
| TRITON B-1956 wetting agent | 5 |

This formulation is stable and homogenous at normal room temperature and moderately elevated temperatures. This formulation may be mixed with zinc sulfate and with the aqueous solution of acetic acid, as described in Example 1 above.

EXAMPLE 5

A formulation similar to Example 3 is prepared substituting the tridecyl (Oxo) polyoxyethylene ethanol having an average of about 10 moles ethyleneoxide as the nonionic material. This formulation is satisfactory and when mixed with zinc sulfate and aqueous acetic acid produces a concentrate which functions substantially the same as that of Example 1.

EXAMPLE 6

A cleaning solution is prepared for used in the composition of Example 1 as follows: Forty gallons of water is added to a 55-gallon mixing drum. Then, 33 pounds calcium hypochlorite is mixed in and dissolved. Next, 5 pounds Stepan EA-10 nonionic surfactant is dissolved in the solution. Next, 2 pounds zinc sulfate is dissolved in hot water and added to the solution in the drum. Finally, 3 ozs. of TRITON B-1956 wetting agent-dispersant is added. The mixture is stirred until completely dissolved and water added to fill the drum.

The solution may be used as is or may be mixed with acetic acid as in Example 1. This solution does not require the further dilution with aqueous bleach for use. In preparing this cleaning solution, sodium hypochorite may be substituted for calcium hypochlorite, or an equivalent amount of hydrogen peroxide may be used.

USE OF CLEANING SOLUTIONS

To remove mold and mildew from the surface, a concentrate having the composition of Example 1 is first mixed with an oxidizing agent such as aqueous bleach. As used throughout this specification and claims, the term "aqueous bleach" is intended to include ordinary household bleach. For best results, the bleach must contain a minimum of 5% wt. sodium hypochlorite. The quantities of bleach indicated hereafter are for bleach containing 5% wt. sodium hypochlorite. In addition to aqueous bleach, peroxide such as sodium peroxide and hydrogen peroxide, and calcium hypochlorite may also be employed as the oxidizing agent.

The zinc sulfate is the primary ingredient responsible for destruction and removal of the mold and mildew. The TRITON B-1956 wetting agent assists in causing the cleaning solution to wet the surface being cleaned and, when dry, resists rewetting and holds enough of the zinc sulfate in place to inhibit regrowth of mold and mildew. The oxidizing agent and the acetic acid in the concentrate also assist in the removal of mold and mildew. Thus, it is usually necessary to add an oxidizing agent, such as bleach, to the concentrate immediately prior to treating a surface. The oxidizing agent may also be included in the dilute cleaning solution as in Example 6.

To treat either exterior wooden surfaces, exterior painted surfaces, metal surfaces, plastic surfaces or vinyl surfaces, 1 pt. of the concentrate having the composition set forth in Example 1 is mixed with 3 pts. of bleach and 2 gals. of water.

To treat stone, brick, stucco or acoustical tile, 1½ pts. of the concentrate, such as that set forth in Example 1, is mixed with 2 qts. bleach and 2 gals. of water.

For interior surfaces, such as painted walls and ceramic tile, the ratio of the concentrate of Example 1 to bleach to water is to 1 to 3 to 26. If the mold and mildew detergent composition is to be sprayed from a 1-qt. sprayer, the sprayer is loaded with 1 oz. of concentrate, 3 oz. of bleach, and 26 oz. of water. If interior walls are to be sprayed from a 4-gal sprayer, such a sprayer is loaded with 1 pt. of concentrate, 3 pts. of bleach and 3 gals. of water.

To apply this fungicidal detergent solution, it is convenient to utilize a garden sprayer that has been loaded with the correct proportion of concentrate, bleach and water. The ingredients may be mixed in the sprayer or mixed first in a separate container. In any event, the ingredients should be mixed a fairly homogenous system in the sprayer. The mixture in the sprayer is then sprayed, preferably as a fine mist over the mildewed area. The first coat kills the mold and mildew. A second coat will clean the surface, and a third coat will work as a protective coating to inhibit regrowth of mold and mildew. The surface may be scrubbed with a brush or sponge of the like if desired.

When successive coats of spray are applied to a surface, it is desirable to wait at least five minutes between applications. In most instances, the protective coating will prevent the regrowth of mold and mildew for periods of up to one to two years. When treating a surface to be painted or repainted, it is desirable to rinse the affected area after being treated. In this regard, it is recommended to rinse the affected areas after treatment only if the surface is going to be painted. After a surface has been painted or repained, a protective coating may then be applied. To apply such protective coatings to freshly painted surfaces, the amount of bleach is reduced to about one-half. Thus, to produce a suitable mixture for protecting painted surfaces, one pt. of the concentrate of Example 1 is mixed with 1½ pts. of bleach and 2–3 gals. water.

The fungicidal detergent solution of the present invention is effective in removing mold and mildew which may be present on a variety of surfaces, such surfaces including stone, brick, stucco, exterior wood, exterior painted surfaces, tile, ceramics, metal and plastic materials, automobile tires, shower walls, refrigerators and boats. The solution may be applied with a large variety of applicators, such applicators including garden sprayers, airless paint sprayers, compressor paint sprayers and hand sprayers, as well as sponges and brushes. The remover solution not only functions as a cleaner to remove the mold and mildew growing on a surface, but also protects the treated surface from reoccurrence of mold and mildew for extended periods of time. The procedures of application and use of the fungicidal detergent concentrate has been described primarily in connection with the concentrate set forth in Example 1. The use of the concentrates of the other Examples is substantially the same. In addition, the solution produced in Example 6 may be used as is or upon further dilution as described in that Example.

While the invention has been described fully and completely with emphasis on several preferred embodiments, it should be understood that within the scope of the appended claims, the invention may be practiced otherwise than as specifically described herein.

I claim:

1. A concentrated cleaning composition which when added to water and an oxidizing agent produces a reactive mixture capable of killing and removing and preventing the regrowth of mold and mildew consisting essentially of the following:

| Constituent | Range in % by Wt. |
|---|---|
| water | 82.4–97.0 |
| organic acid selected from the group consisting of acetic acid, formic acid, propionic acid, n-hexanoic acid, lactic acid, citric acid, n-butanoic acid, n-pentanoic acid, trimethyl-acetic acid, methoxyacetic acid, cyano-acetic acid, chloracetic acid, and tartaric acid | 2.0–10.0 |
| at least one penetrant selected from the group consisting of alkanolamide detergents and the sodium salts of ethylenediamine tetracetic acid | 0–0.8 |
| sodium tripolyphosphate | 0–0.8 |
| at least one surfactant selected from the group consisting of higher alkyl mononuclear aryl sulfonates, alkyl polyethoxamer detergents, alkanolamine detergents, and alkanolamide detergents | 0.1–1.0 |
| fungicide selected from the group consisting of zinc sulfate, zinc acetate, zinc bromide, zinc chloride, zinc iodide, zinc nitrate, zinc bromate and zinc chlorate | 0.2–2.0 |
| wetting-dispersing agent consisting of the condensation polymerization product of the reaction of polyglycerol with phthalic anhydride | 0.05–1.0 |
| sodium metasilicate degreasant | 0–2.0 |

2. A composition according to claim 1, in which said acid is acetic acid, said penetrant is EDTA and said surfactant is a linear alkoxypolyoxyalkylene ethanol, non-ionic detergent.

3. A composition according to claim 1 including additionally a water soluble oxidant selected from the group consisting of sodium hypochorite, calcium hypochlorite, hydrogen peroxide and sodium peroxide.

4. A composition according to claim 1 in which said acid is acetic acid.

5. A method of removing mold and mildew from surfaces and preventing regrowth thereon which comprises cleaning and coating such surface with an aqueous solution as defined in claim 1.

6. A method of removing mold and mildew from surfaces and preventing regrowth thereon which comprises cleaning and coating such surface with an aqueous solution as defined in claim 3.

* * * * *